US005523534A

United States Patent [19]

Meister et al.

[11] Patent Number: 5,523,534

[45] Date of Patent: Jun. 4, 1996

[54] SHIELDED CARBON LEAD FOR MEDICAL ELECTRODES

[75] Inventors: Mark L. Meister, Hamilton; Edward F. Hoar, Centerville, both of Ohio

[73] Assignee: Vital Connections, Inc., Tipp City, Ohio

[21] Appl. No.: 82,770

[22] Filed: Jun. 28, 1993

[51] Int. Cl.[6] ..... H01B 7/34

[52] U.S. Cl. ..... 174/36; 128/639; 174/102 SC; 174/106 R; 174/106 SG

[58] Field of Search ..... 174/36, 106 SC, 174/102 SC, 106 R, 110 R; 338/214; 128/639

[56] References Cited

U.S. PATENT DOCUMENTS

| | | | |
|---|---|---|---|
| 3,284,751 | 11/1966 | Barker et al. | 338/66 |
| 3,680,027 | 7/1972 | Vitale | 338/214 |
| 3,683,309 | 8/1972 | Hirose | 174/36 |
| 3,991,397 | 11/1976 | King | 174/102 SC |
| 4,369,423 | 1/1983 | Holtzberg | 338/66 |
| 4,442,315 | 4/1984 | Segawa | 174/36 |
| 4,539,995 | 9/1985 | Sewawa | 174/36 |
| 4,704,596 | 11/1987 | Coffey et al. | 338/214 |
| 4,734,545 | 3/1988 | Susuki et al. | 174/120 SR |
| 4,739,935 | 4/1988 | Hastings et al. | 174/102 |
| 4,748,436 | 5/1988 | Kanamori et al. | 338/214 |
| 5,034,719 | 7/1991 | Brown et al. | 174/102 SC |
| 5,250,756 | 10/1993 | Swift et al. | 174/119 R |
| 5,265,579 | 11/1993 | Ferrari | 128/640 |

*Primary Examiner*—Morris H. Nimmo
*Attorney, Agent, or Firm*—Jacox & Meckstroth

[57] ABSTRACT

An elongated flexible lead conducts electrical biosignals from a medical electrode attached to a person's skin to a recording instrument and the lead is translucent to X-rays. The lead includes a primary center conductor formed by a bundle of conductive fibers such as carbon fibers, and a tubular layer of electrical insulating plastic material surrounds the fibers. An electrical conducting non-metallic shielding member extends around the tubular layer, and in one embodiment includes a bundle of the carbon fibers surrounded by a tubular layer of electrical conductive plastic material. A tubular layer of electrical insulating plastics material surrounds the shielding member, and the shielding member has an effective low electrical resistance close to that of the primary center conductor.

11 Claims, 1 Drawing Sheet

SHIELDED CARBON LEAD FOR MEDICAL ELECTRODES

BACKGROUND OF THE INVENTION

In the use of medical electrodes of the type which are adhesively attached to a person's skin for measuring electrical biosignals generated from the person's body, it is common to use a flexible lead wire for connecting the electrode to a recording instrument such as an electrocardiogram machine. The lead wire may consist of multiple metal strands or a bundle of carbon fibers surrounded by an extruded tubular layer of electrical insulating plastic material. It has been found desirable to shield the lead wires to prevent electrostatic or electromagnetic noise in the surrounding area and especially the high noise generated in a hospital from mixing with the biosignals being conducted by the lead wires. The shielding is usually accomplished by a braided metal wire or deposited metal layer which surrounds the tubular layer of electrical insulating material. The braided wire or metal layer is surrounded by another extruded tubular layer of electrical insulating material.

Sometimes it is desirable to take X-rays of a person's body to which is attached a plurality of electrodes which are connected to corresponding lead wires extending to a recording instrument. However, when the shielded lead wires are being used to connect the electrodes to the recording instrument, the metal in the lead wires blocks or is opaque to the passage of X-rays and produces undesirable images on the X-ray film. One proposed solution to this problem has been a combined electrode and lead wire assembly as disclosed in U.S. Pat. No. 4,442,315. In this patent, a generally flat lead wire is formed as an integral part of a generally flat electrode and includes deposited band-like layers of electrically conducting material in the form of a conductive paste and carbon shield layers. However, since the lead wire is made integrally with the electrode, it is necessary to dispose of a lead wire with each electrode. In addition, the lead wire disclosed in this patent cannot be produced on conventional wire manufacturing equipment. Other forms of shielded conductors or wires or cables and commonly used for ignition cables, are disclosed in U.S. Pat. Nos. 3,680,027, 3,683,309, 3,991,397, 4,748,436 and 5,034,719. However, after reading each of the patents, it is apparent none of the shielded cables disclosed in these patents would function effectively as a lead wire for a medical electrode and for also being translucent to X-rays.

SUMMARY OF THE INVENTION

The present invention is directed to an improved elongated flexible lead for use in conducting electrical biosignals from a medical electrode attached to a person's skin to a recording instrument. The lead is not only effectively shielded to minimize electrostatic or electromagnetic noise in the surrounding environment from mixing with the biosignals conducted by the lead, but is also translucent to X-rays so that the person's body may be X-rayed without removing the flexible leads and while the biosignals are being recorded or visually inspected on a screen. A flexible lead shielded lead of the invention may also be economically produced with conventional equipment for producing flexible wires or conductors. The opposite end portions of each reusable lead are also adapted to be connected to corresponding coupling members for releasably attaching the lead to a recording instrument and a disposable medical electrode.

In accordance with one embodiment of the invention, a lead includes a center electrical conductor formed by a bundle of conductive fibers such as carbon fibers, and an extruded tubular layer of electrical insulating plastic material surrounds the bundle. Another bundle of electrical conducting fibers such as carbon fibers extend around the tubular insulating layer in a helical fashion to form a first shielding member. The carbon fibers are overlaid by a second or primary shielding member in the form of an extruded tubular layer of electrical conductive plastic material. An outer tubular layer of electrical insulating plastic material surrounds the second shielding member, and both of the contacting shielding members cooperate to provide a combined relatively low electrical resistance corresponding to that of the center conductor of carbon fibers. The carbon fibers may also be located outwardly or wrapped around the primary shielding member.

Other features and advantages of the invention will be apparent from the following description, the accompanying drawing and the appended claims.

DESCRIPTION OF THE PREFERRED EMBODIMENT

Figure 1:
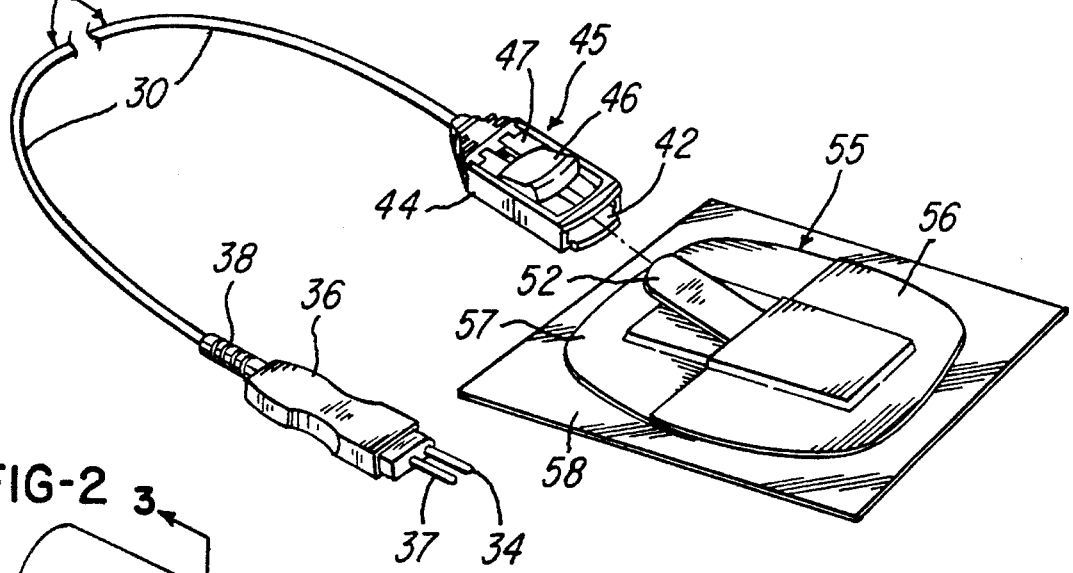
FIG. 1 is a perspective view of a shielded lead constructed in accordance with the invention and shown uncoupled to a medical electrode.
Figure 2:
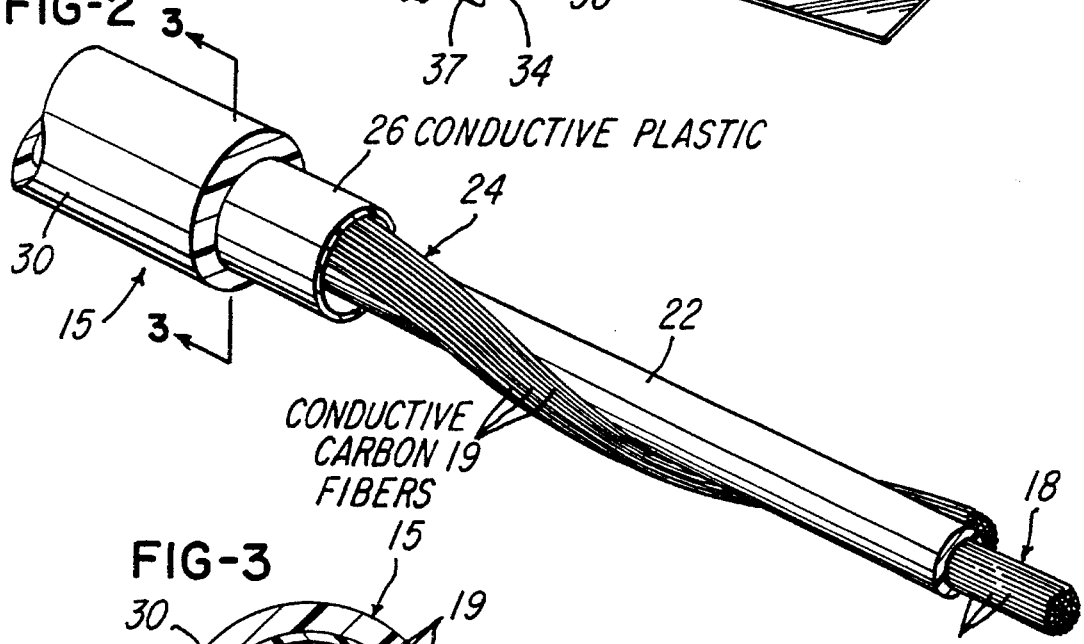
FIG. 2 is a greatly enlarged fragmentary perspective view of the shielded lead shown in FIG. 1.
Figure 3:
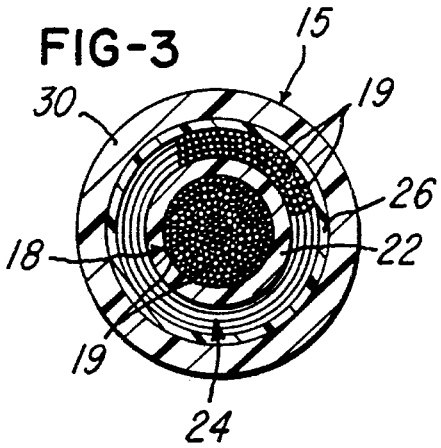
FIG. 3 is a cross-section taken generally on the line 3—3 of FIG. 2.

FIG. 1 illustrates an elongated flexible lead 15 which is constructed in accordance with the invention and has a outer diameter preferably within the range 0.106 to 0.114 inch. As shown in FIG. 2, the lead 15 includes a center conductor 18 in the form of a bundle of conductive fibers such as a bundle of 3000 PolyAcrylo Nitrite (PAN) carbon fibers 19, and the conductor 18 has an electrical resistance of about 50 ohms DC per linear foot. An extruded tubular layer 22 of electrical insulating material, preferably polyurethane, surrounds the center conductor 18, and another cord or bundle 24 of conductive fibers such as the carbon fibers 19 extend around the insulating layer 22 to form a first shielding member. In the embodiment shown in FIG. 2, the bundle 24 of carbon fibers 19 are helically wrapped around the tubular insulating layer 22, but the fibers 19 may also be woven or braided to form a tubular layer or casing of carbon fibers. The conductive fibers may also be in the form of non-woven or woven nylon threads each having a coating of metal such as silver which is coated by vapor deposition.

Surrounding the helically wrapped bundle 24 of carbon fibers forming the first shielding member is a primary or second shielding member in the form of an extruded tubular layer 26 of electrically conductive plastic material such as conductive polyurethane. The electrical resistance of the tubular layer 26 is usually within the range of 400 to 500 ohms DC per linear foot. However, as a result of the physical contact of the conductive layer 26 with the low resistance conductive carbon fibers 19 of the bundle 24, the two shielding members cooperate to provide a combined effective resistance close to the resistance of the primary conductor 18 or within a range of about 50–55 ohms DC per linear foot.

This combined low resistance of the first and second shielding members has been found to be significantly effective in shielding noise interference, especially the 60 HZ interference which is commonly generated in hospitals. It is also possible to locate the bundle 24 of conductive fibers around the conductive tubular layer 26, but the arrangement shown in FIG. 2 is preferred for production purposes.

The lead 15 has an outer protective insulating jacket or tubular layer 30 of electrical insulating plastics material such as polyurethane. The tubular layer 30 is extruded over the extruded layer 26 of conductive plastic material and thus electrically insulates the entire assembly of the lead 15.

Referring to FIG. 1, the center conductor 18 of the lead 15 is connected at one end to a metal coupling pin 34 projecting from a plug body 36 of molded electrical insulating plastic material. The shielding fiber bundle 24 and tubular layer 26 are connected to a metal coupling pin 37 within the plug body 36. The plug body 36 is also molded to the adjacent end portion of the outer jacket or layer 30 of the lead 15, and a flexible helical portion 38 of the plug body surrounds the outer layer 30 to avoid sharp flexing of the lead 15 adjacent the plug body.

At the opposite end of the lead 15, the center conductor 18 is connected to a generally flat electrical conducting plate or tab 42 which is enclosed within a molded body 44 of electrical insulating plastic material forming a part of a releasable coupler 45. The body 44 is molded to the outer layer 30 to secure the body to the lead 15. The coupler 45 also has a thumb button 46 which slides on a sloping ramp or cam surface 47 for clamping the conductor plate 42 to a flexible electrical conductive tab 52 forming part of a disposable medical electrode 55.

The electrode 55 includes overlapping panels 56 and 57 of flexible elastic material, and the panels are releasably attached by a suitable adhesive to a flexible carrier film or panel 58. The bottom surface of the tab 52 under the panel 56 is attached to an electrical conductive flexible panel (not shown) which carries an electrical conductive adhesive for contacting the persons skin. The releasable coupler 45 and the disposable medical electrode 55 form no part of the present invention and are inventions of the 3M Company. The lead 15 of the present invention may be used with many different types of couplers.

From the drawing and the above description, it is apparent that a flexible lead constructed in accordance with the present invention, provides desirable features and advantages. For example, the lead 15 does not incorporate any magnetically attractable material, but incorporates only materials which are translucent to or penetrated by X-rays. In addition, the center conductor 18 of fibers 19 is effectively shielded by a low resistance shielding member. The illustrated form of shielding member includes the extruded tubular layer 26 of conductive plastic material which contacts the conductive carbon fibers 19 forming the bundle 24. The lead 15 is also adapted to be economically and efficiently produced on conventional wire production equipment and is extremely flexible and durable so that the lead has an extended service life.

While the form of lead herein described and its method of production constitute a preferred embodiment of the invention, it is to be understood that the invention is not limited to the precise form of lead disclosed, and that changes may be made therein without departing from the scope and spirit of the invention as defined in the appended claims.

The invention having thus been described, the following is claimed:

1. An elongated flexible lead adapted for conducting electrical signals from a medical electrode attached to the person's skin to a recording instrument and for passing X-rays through said lead, said lead comprising a center electrical conductor including a bundle of electrical conducting fibers, a first tubular layer of electrical insulating material surrounding said bundle of fibers, a first shielding member including a bundle of electrical conducting fibers extending around said first tubular insulating layer, a second shielding member including a tubular layer of electrical conductive non-metallic material contacting said fibers forming said first shielding member, a second tubular layer of electrical insulating material surrounding said second shielding member, and said first shielding member cooperating with the contacting second shielding member to provide a combined electrical resistance substantially lower than that of said second shielding member.

2. A lead as defined in claim 1 wherein said bundle of fibers forming said first shielding member are helically wrapped around said first tubular layer of electrical insulating material.

3. A lead as defined in claim 1 wherein said fibers forming said center conductor and said first shielding member have an electrical resistance of about 50 ohms DC per linear foot.

4. A lead as defined in claim 1 wherein said tubular layer forming said second shielding member comprises a tube of conductive plastic material surrounding said first shielding member.

5. A lead as defined in claim 4 wherein said conductive plastic material comprises a conductive polyurethane.

6. An elongated flexible lead adapted for conducting electrical signals from a medical electrode attached to the person's skin to a recording instrument and for passing X-rays through said lead, said lead comprising a center electrical conductor including a bundle of carbon fibers, a first tubular layer of electrical insulating plastics material surrounding said bundle of carbon fibers, a first shielding member including electrical conducting carbon fibers wrapped around said first tubular insulating layer in a helical pattern, a second shielding member including a tubular layer of electrical conductive plastic material surrounding said carbon fibers forming said first shielding member, a second tubular layer of electrical insulating material surrounding said second shielding member, and said first shielding member cooperating with the surrounding second shielding member to provide a combined electrical resistance substantially lower than that of said second shielding member.

7. A lead as defined in claim 6 wherein said carbon fibers forming said center conductor and said first shielding member have an electrical resistance of about 50 ohms DC per linear foot.

8. A lead as defined in claim 6 wherein said tubular layer forming said second shielding member comprises a conductive polyurethane.

9. An elongated flexible lead adapted for conducting electrical signals from a medical electrode attached to the person's skin to a recording instrument and for passing X-rays through said lead, said lead comprising a center electrical conductor including a bundle of electrical conducting fibers, a first tubular layer of electrical insulating material surrounding said bundle of fibers, an electrical conductive non-metallic shielding member extending around said first tubular insulating layer, said shielding member including electrical conductive fibers disposed around said first tubular layer of electrical insulating material, a tubular layer of electrical conductive plastic material contacting said fibers and also surrounding said first tubular layer to provide said shielding member with an electrical resistance generally close to that of said center conductor, and a second tubular layer of electrical insulating material surrounding said shielding member.

10. An elongated flexible lead adapted for conducting electrical signals from a medical electrode attached to the person's skin to a recording instrument and for passing X-rays through said lead, said lead comprising a center electrical conductor including a bundle of electrical conducting fibers, a first tubular layer of electrical insulating material surrounding said bundle of fibers, an electrical conductive non-metallic shielding member extending around said first tubular insulating layer, said shielding member including means providing said shielding member with an electrical resistance of about 50 ohms DC per linear foot and generally close to that of said center conductor, and a second tubular layer of electrical insulating material surrounding said shielding member.

11. An elongated flexible lead adapted for conducting electrical signals from a medical electrode attached to the person's skin to a recording instrument and for passing X-rays through said lead, said lead comprising a center electrical conductor including a bundle of electrical conducting fibers, a first tubular layer of electrical insulating material surrounding said bundle of fibers, an electrical conductive non-metallic shielding member extending around said first tubular insulating layer, said shielding member comprising means including a tubular layer of conductive polyurethane for providing said shielding member with an electrical resistance generally close to that of said center conductor, and a second tubular layer of electrical insulating material surrounding said shielding member.

* * * * *